United States Patent [19]

Hurst

[11] 4,219,067

[45] Aug. 26, 1980

[54] ANTI-RATTLE CURTAIN ASSEMBLY

[75] Inventor: Geoffrey J. Hurst, Lugarno, Australia

[73] Assignee: Byrne & Davidson Doors (N.S.W.) Pty. Limited, Revesby, Australia

[21] Appl. No.: 888,526

[22] Filed: Mar. 21, 1978

[30] Foreign Application Priority Data

Mar. 23, 1977 [AU] Australia ..... 9525/77

[51] Int. Cl.[2] ..... E05F 7/04

[52] U.S. Cl. ..... 160/133; 16/1 R; 16/DIG. 6; 160/201; 160/235; 292/DIG. 73; 403/149

[58] Field of Search ..... 16/93 R, 93 D, DIG. 6, 16/1 R, 87.2, 94 R, 94 D, 95 R, 95 D, 96 R, 96 D; 292/DIG. 73, DIG. 38; 403/149; 248/358 R; 308/3 R, 3.6, DIG. 7; 160/201, 235; 24/3 J, 3 L, 73 C, 73 SS, 121

[56] References Cited

U.S. PATENT DOCUMENTS

| | | | |
|---|---|---|---|
| 682,328 | 9/1901 | Kinneas | 160/235 |
| 1,081,202 | 12/1913 | Brunst | 160/235 |
| 1,081,486 | 12/1913 | Cahill | 160/235 |
| 2,736,018 | 2/1956 | Samson | 248/358 R |

*Primary Examiner*—Leslie Braun
*Assistant Examiner*—Moshe I. Cohen
*Attorney, Agent, or Firm*—Fleit & Jacobson

[57] ABSTRACT

An anti-rattle element for a curtain of a closure, the curtain having a corrugated surface and, adjacent to its edges, either a strap riveted to crests of each corrugation or bridges extending across the troughs of the corrugations. The strap or bridges form detent surfaces engageable by a resilient latching tongue protruding rearwardly from a body of the anti-rattle element. The tongue has a tip that engages either the bridge or the strap to hold the anti-rattle element to the curtain. The body of the element also has first and second abutment side faces and a rear face having a recess therein which embraces a portion of an edge margin of the curtain. The anti-rattle element is connected to the curtain in such manner that its abutment faces are disposed respectively on opposite sides of the curtain and face outwardly therefrom.

9 Claims, 16 Drawing Figures

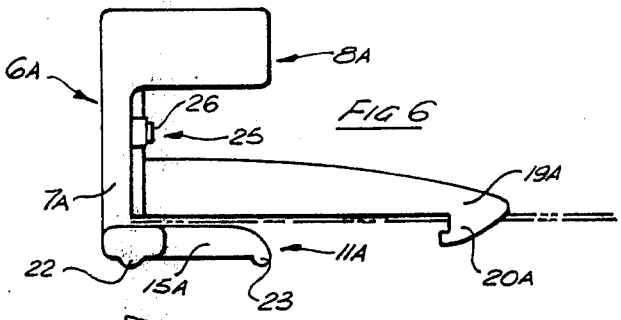
FIG 6
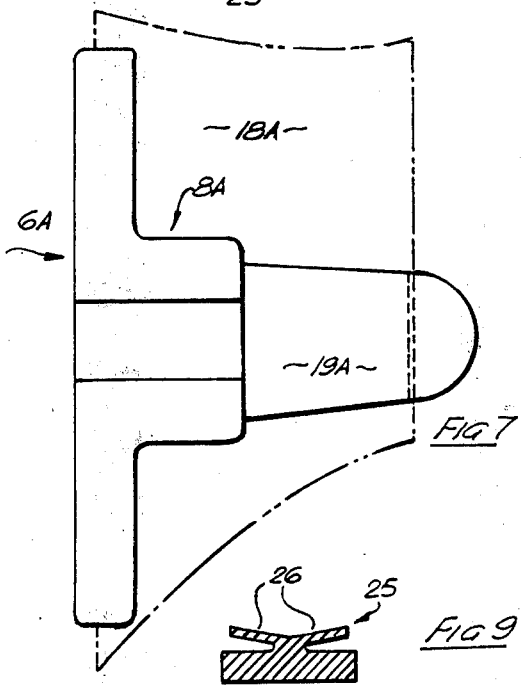
FIG 7
FIG 9
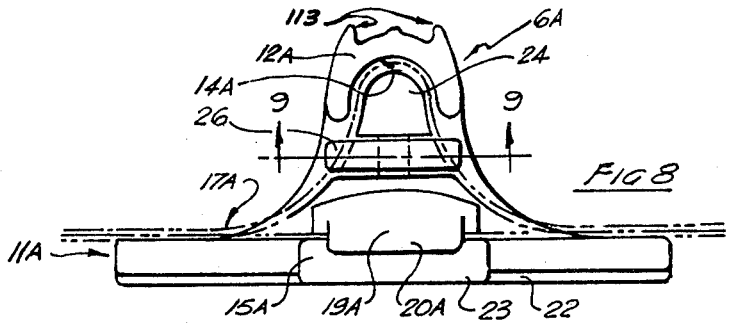
FIG 8

ANTI-RATTLE CURTAIN ASSEMBLY

This invention relates to closures for building wall openings and the like of the kind in which a "curtain sheet" slides substantially in the plane of the opening in guideways at opposite edges of the opening from a closed position wherein it fills the opening to an open position wherein it is disposed above, below or to one side of the opening and vice versa. Usually, the curtain shutter slides in the vertical direction in guideways extending vertically of the side edges of the opening, and again in most cases the curtain shutter slides upwardly to open the opening and is then wrapped upon a drum structure extending horizontally above the opening or slides into terminal portions of the guideways disposed above the opening.

The term "curtain sheet" as used herein covers corrugated or similarly conformed sheets as well as sheet-like structures comprising a plurality of slats or sheet portions hinged together which are stiff in one direction and flexible in a direction at 90° to the said one direction. Thus the curtain sheet may effectively close the opening when held at its edges by the aforesaid guideways, but nevertheless may, for example, be rolled onto a drum structure above the opening to open the closure.

Typically, closures of the kind in question are used as garage doors or as doors in factory buildings and they are well known and require no detailed description. For the sake of convenience, all such "curtain sheets" are referred to as "curtains" hereinafter.

Conventionally, the curtain is provided with anti-rattle devices at its edges so that it is a relatively neat fit within the guideways at the edges of the opening within which the curtain slides.

Hitherto, those anti-rattle structures have usually comprised separate elements applied to each side of the curtain. Typical anti-rattle elements comprise wooden blocks, plastics studs or buttons secured to the curtain, or in one widely used instance, the anti-rattle devices comprise pairs of resilient strips at opposite edges of the curtain extending longitudinally thereof, with the members of each pair respectively on opposite sides of the curtain and secured to the curtain by staples or the like passing through both strips of the pair and the curtain.

In all of the prior known instances where, as is desirable, anti-rattle devices at each edge are provided on each side of the curtain, it has been necessary for them to be assembled to the curtain from each side. This has added to the cost of assembly and manufacture of the closures and an object of the present invention is to provide an inexpensive anti-rattle element which may be applied to the edge of the curtain to provide rubbing surfaces on each side of the curtain without requiring separate operations to be carried out from each side of the curtain.

The invention achieves that purpose by providing an anti-rattle element for the curtain of a closure, as defined herein, comprising a body having first and second abutment faces, and a rear surface adapted to contact a portion of an edge, or edge margin, of said curtain with said first and second abutment faces then disposed respectively on opposite sides of the curtain and facing outwardly therefrom and retainer means on said body to secure said element to said curtain.

According to preferred embodiments of the invention the entire element is a one piece moulding of resilient plastics material and the means on the body of the element to secure the element to the curtain automatically engage a detent formation formed in the curtain as the element is applied thereto.

For example, the element may be resilient and may have a knob or boss or the like on it which is adapted to enter a hole formed in the curtain for the purpose of retaining the element in position. Alternatively, the means for securing the element to the curtain may comprise a resilient latching tongue or the like adapted to hook over and thereby engage a lug or other protrusion on the curtain.

By way of example, preferred embodiments of the invention are described hereinafter with reference to the accompanying drawings.

FIG. 6 is a view similar to FIG. 1 of a second anti-rattle element according to the invention.

FIG. 7 is a view similar to FIG. 2 of the element of FIG. 6 applied to a curtain.

FIG. 8 is a view similar to FIG. 3 of the embodiment of FIG. 6.

FIG. 9 is a sectional view taken on line 9—9 of FIG. 8.

Figure 1:
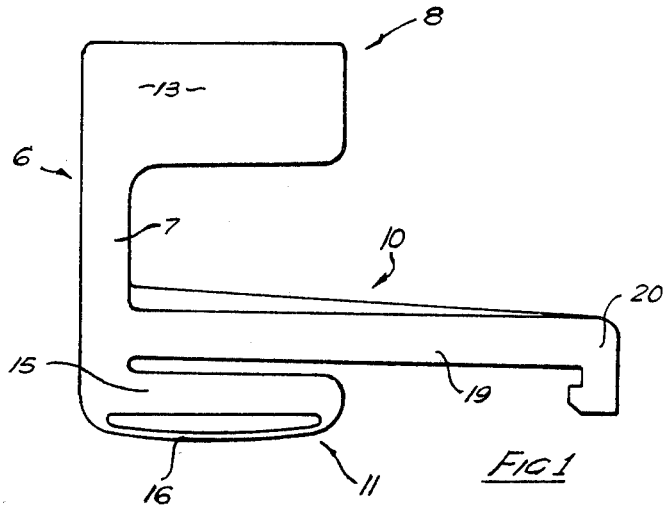
FIG. 1 is a side elevation of an anti-rattle element according to the invention.

The embodiment of the invention illustrated by FIGS. 1 to 5 is a one-piece moulding of nylon or other resilient plastics material which, in the moulded form, has a low coefficient of friction. The moulding comprises a body 6 which itself comprises a web 7 from which projects a first flange structure 8, a resilient latch arm 10 and a second flange structure 11.

The first flange structure 8 comprises a flange 12 of arcuate cross-section and, integral therewith, two curved relatively thin fins 13 spaced, except at their junction therewith, from the flange 12.

Figure 3:
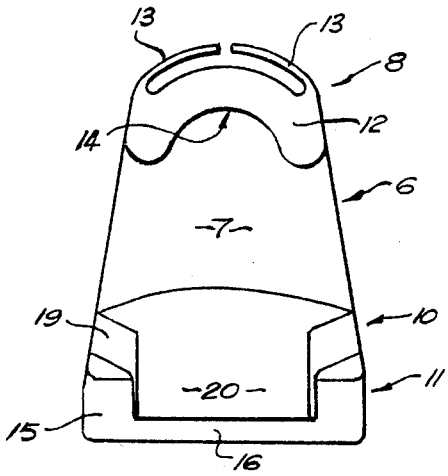
FIG. 3 is a rear elevation of the element of FIG. 1.

In use, the upper surfaces of the fins 13 (as seen in FIG. 3) constitute one of the abutment surfaces of the element, that is to say, in use, they contact and slide upon a guiding surface of the guideway for the curtain, and due to their ability to flex resiliently, provide a cushioning effect which prevents or, at least greatly lessens, any rattling which otherwise might occur between the curtain and the guideway.

The flange 12 defines an arcuate abutment surface 14 adapted to contact an edge surface portion of the trough of a corrugation of a corrugated curtain, as is described in more detail hereinafter.

The flange structure 11 comprises a flange 15 of rectangular cross-section and a slightly bowed, relatively thin bridge piece 16, which functions in much the same way as the fins 13 to provide resilience in the lower surface of the element, it being the outer face of the bridge piece 16 which constitutes the element's second abutment surface.

Figure 4:
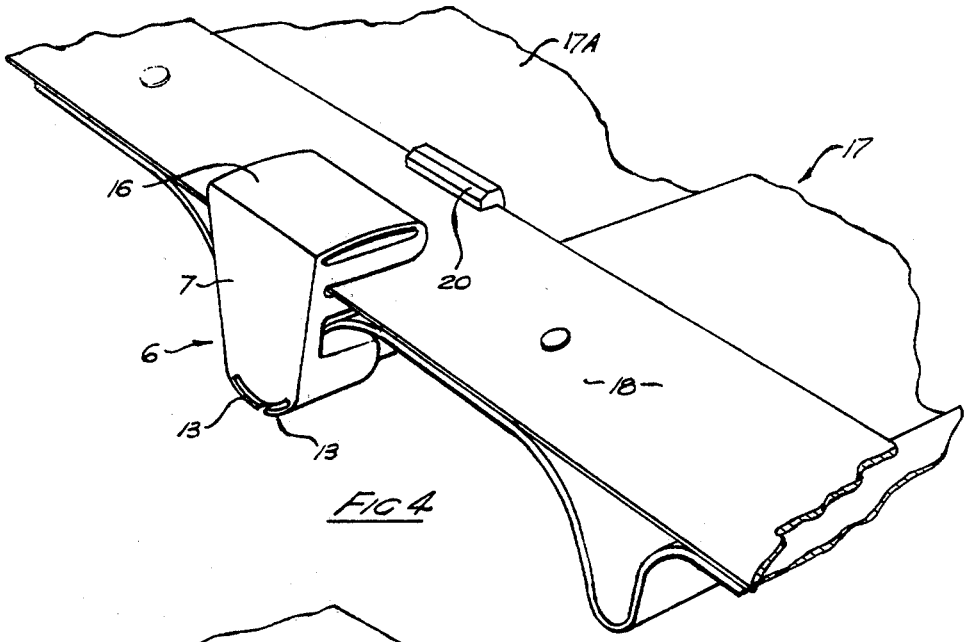
FIG. 4 is a perspective view of the element of FIG. 1 shown in position as applied to the corrugated curtain of a curtain shutter.

Turning now to FIG. 4, there is shown shutter curtain 17 comprising a corrugated metal sheet 17A of conventional kind and a strap 18 riveted to the crests of each corrugation of the sheet 17A. The figure illustrates the emplacement of an element according to FIGS. 1 to 3 and it will be seen that the resilient latch arm 10, which includes a cantilever portion 19 and a hooked, end flange 20, hooks over the strap 18 while the edge portion of a trough of a corrugation of the sheet 17A contacts the surface 14. Thus, the element is secured in position and may be placed in position from one edge of the sheet 17A simply by manually or otherwise thrusting it into engagement as shown in FIG. 4. Under those circumstances, the bridge piece 16 and the fins 13 provide resilient abutment surfaces one on each side of the sheet 17A and facing away therefrom.

Figure 2:
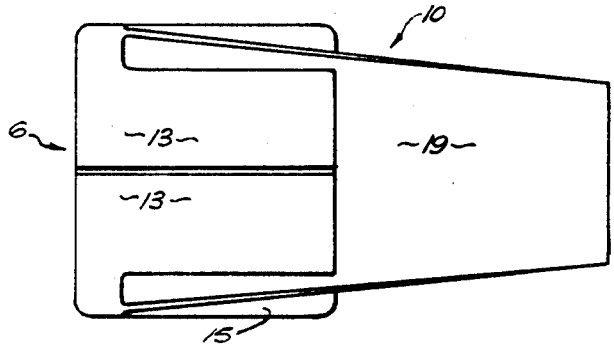
FIG. 2 is a plan view of the element of FIG. 1.
Figure 5:
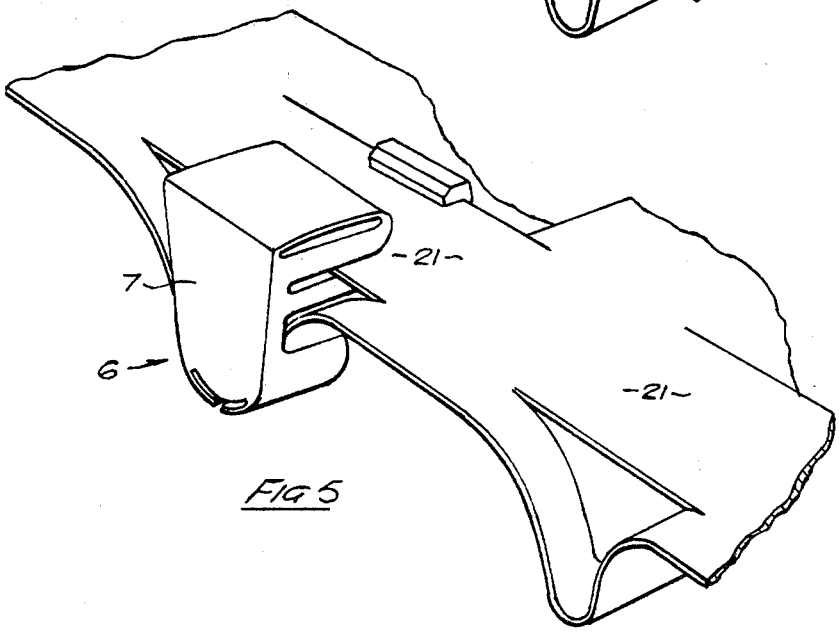
FIG. 5 is a view similar to FIG. 4 of the element applied to a second type of corrugated curtain of a curtain shutter.
Figure 10:
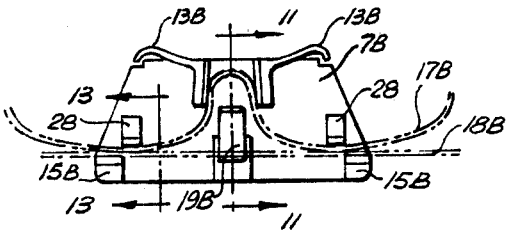
FIG. 10 is a view similar to FIG. 3 of still another embodiment of the invention.
Figure 11:
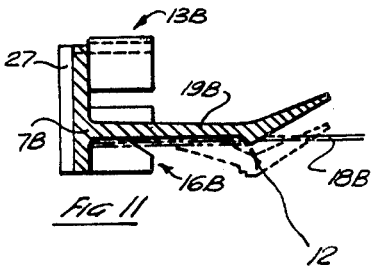
FIG. 11 is a sectional view taken on line 11—11 of FIG. 10.
Figure 14:
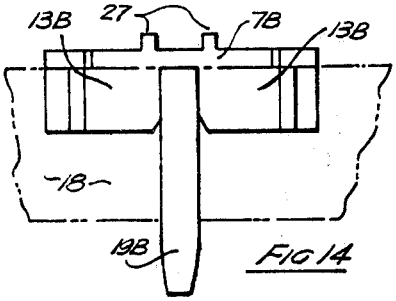
FIG. 14 is a view similar to FIG. 2 of the embodiment of the invention of FIG. 10.
Figure 13:
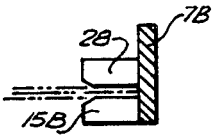
FIG. 13 is a sectional view taken on line 13—13 of FIG. 10.
Figure 12:
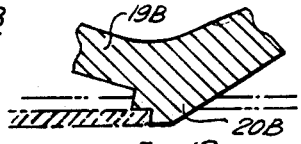
FIG. 12 is a detailed view of that portion of FIG. 11 within the enclosure marked 12 thereon, drawn to a larger scale.
Figure 15:
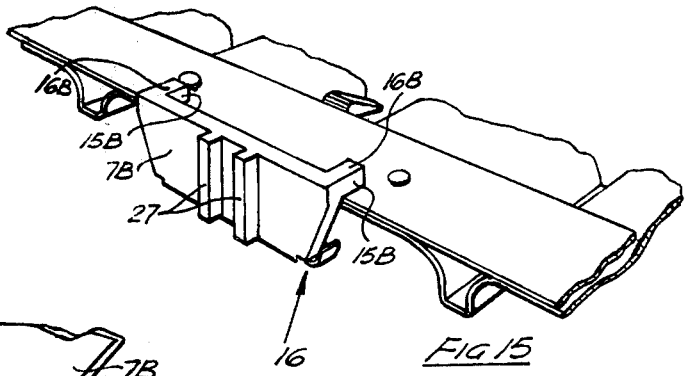
FIG. 15 is a perspective view of the anti-rattle element of FIG. 10 shown applied to a curtain.
Figure 16:
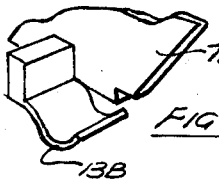
FIG. 16 is a view seen from the reverse side and drawn to a larger scale of that portion of FIG. 15 within the enclosure marked 16 thereon.

FIG. 5 illustrates the emplacement of the element of FIGS. 1, 2 and 3 on a sheet similar to sheet 17A, but one which does not have a strap corresponding to 18 but rather is formed with bridges 21 extending across the troughs of the corrugations adjacent to the edges thereof to constitute detent formations adapted to be engaged by the resilient tongue 10 in exactly the same way as that tongue engages the strap 18 of FIG. 4.

The embodiment of the invention illustrated by FIG. 6 is similar in function and very largely in conformation to the embodiment illustrated by FIGS. 1 to 5 and those parts which correspond clearly to parts of the FIG. 1 embodiment are not described in detail hereinafter but their reference numerals correspond to those used in FIGS. 1 and 5 followed by the suffix A.

The primary difference between the two embodiments is that in the FIG. 6 embodiment the fins 13 of the FIG. 1 embodiment are replaced by two ribs 113, flange structure 11A is considerably more elongate than flange structure 11 and in place of the bridge piece 16 is furnished with a bead 22. The central portion of the structure 11A comprises a projecting tongue 15A corresponding to the flange 15 and furnished with a second bead 23. In this embodiment of the invention, ribs 113, and the beads 22 and 23 define the first and second abutment faces of the anti-rattle element.

The web at 7A, unlike web 7, includes a rounded thickened portion 24, which together with the surface 14A defines a groove into which the edge margin of the mound of the corrugated sheet 17A is homed when the element is applied thereto.

The hooked end flange 20A is maintained in pressure contact with the strap 18A by virtue of a resilient buffer 25 integral with the web 7A and including 2 resiliently deformable wings 26 which make contact with the edge of the sheet 17A.

The embodiment of the invention illustrated in FIGS. 10 to 16 is also similar in function to those of the earlier described embodiments, although it differs somewhat more in arrangement or shaping from the FIG. 1 embodiment than does the FIG. 6 embodiment. Nevertheless, those parts which correspond in function to parts of the FIG. 1 embodiment are not described further hereinafter as they may be comprehended from the earlier description having regard to the fact that the reference numerals in FIGS. 10 to 16 correspond to those of FIGS. 1 to 5, but followed by the suffix B.

It will be noted, by reference to FIGS. 10 to 16, that the web 7B of this embodiment is furnished with two protruding beads 27 adapted to make contact with the inner face of the floor of the channel constituting the guide for the curtain of the shutter. Due to the lack of resilience in beads 27 compared for example with the wings 26 of the FIG. 6 embodiment of the invention, the hooked portion of the resilient latch arm 20B is provided with two engaging faces (see FIG. 12) to compensate for possible variations in width of the strap 18B and the spacing between the guides within which the shutter runs.

It will also be seen that the resilient fins 13 are replaced by fins 13B which extend outwardly from the centre line of the element rather than inwardly as in the earlier described embodiment of the invention.

The flange 15 is replaced by two relatively short abutment elements 15B and adjacent thereto are further similar abutment elements 28 which make contact with the opposite side of the curtain sheet from that contacted by element 15B.

The claims defining the invention are as follows:

1. A curtain assembly comprising an anti-rattle element and a curtain of a movable closure, the curtain having generally parallel edges and a plurality of engageable portions positioned adjacent at least one of the parallel edges, the engageable portions being at least partially spaced from adjoining portions of the curtain, said anti-rattle element comprising:

a body having first and second abutment side faces and a rear face having a recess therein for embracing a part of the edge of the curtain in such manner that said abutment side faces are disposed on opposite sides of the curtain and face outwardly therefrom; and a resilient latching tongue protruding from said rear face of said body and having a tip quick-releasably engageable with one of the engageable portions of the curtain to hold said anti-rattle element to the curtain.

2. A curtain assembly according to claim 1, wherein the engageable portions of the curtain are formed by a strap affixed to a shutter portion of the curtain, and wherein said tip is shaped to hook over an edge of the strap.

3. An anti-rattle element according to claim 2, wherein said latching tongue includes a plurality of formations respectively spaced to differing extents from said rear face, one of said formations being engageable with the strap, said formations facilitating engagement of said tip with different width straps.

4. An anti-rattle element according to claim 2, wherein said rear face includes a resiliently displaceable portion.

5. An anti-rattle element according to claim 4, wherein said resiliently displaceable portion is an outer surface of a curved resilient fin protruding from said rear face.

6. An anti-rattle element according to claim 1, wherein the curtain has a corrugated surface with troughs extending transversely to the parallel edges, wherein said recess of said rear face is adapted to embrace at least a part of a trough wherein the engageable portions of the curtain are formed by bridges extending across the troughs, and having lower surfaces facing the troughs, and wherein said tip is passable underneath the lower surface and has a hook-shaped portion engageable with an edge of the bridge.

7. An anti-rattle element according to claim 6, wherein said latching tongue includes a plurality of formations respectively spaced to differing extents from said rear face, one of said formations being engageable with the strap, said formations facilitating engagement of said tip with different width straps.

8. An anti-rattle element according to claim 6, wherein said rear face includes a resiliently displaceable portion.

9. An anti-rattle element according to claim 8, wherein said resiliently displaceable portion is an outer surface of a curved resilient fin protruding from said rear face.

* * * * *